United States Patent [19]

Hasegawa et al.

[11] Patent Number: 4,804,021

[45] Date of Patent: Feb. 14, 1989

[54] HIGHLY TOUGH ERW STEEL PIPE WITH DISTINGUISHED SOUR RESISTANCE

[75] Inventors: Yasushi Hasegawa; Hiroyo Haga, both of Sagamihara, Japan

[73] Assignee: Nippon Steel Corporation, Tokyo, Japan

[21] Appl. No.: 124,863

[22] Filed: Nov. 24, 1987

[30] Foreign Application Priority Data

Nov. 28, 1986 [JP] Japan ..... 61-281841

[51] Int. Cl.[4] ..... F16L 9/02

[52] U.S. Cl. ..... 138/171; 138/177; 148/909; 148/332; 148/333; 148/334; 148/335; 148/320

[58] Field of Search ..... 138/171, 177; 428/586, 428/683; 148/909, 320, 332–336; 420/125, 93, 109, 110

[56] References Cited

FOREIGN PATENT DOCUMENTS

| | | | |
|---|---|---|---|
| 136512 | 10/1979 | Japan . | |
| 17065 | 4/1982 | Japan . | |
| 16184 | 4/1982 | Japan . | |
| 140823 | 8/1982 | Japan . | |
| 1015 | 1/1983 | Japan . | |
| 53-707 | 11/1983 | Japan . | |
| 53-708 | 11/1983 | Japan . | |
| 58-212847 | 12/1983 | Japan | 148/320 |
| 53-656 | 3/1984 | Japan . | |
| 124554 | 6/1986 | Japan . | |
| 170458 | 7/1987 | Japan . | |
| 2131832 | 6/1984 | United Kingdom | 420/125 |

*Primary Examiner*—Deborah Yee

*Attorney, Agent, or Firm*—Wenderoth, Lind & Ponack

[57] ABSTRACT

A highly tough, ERW steel pipe having a distinguished sour resistance is disclosed. The steel pipe is prepared from steel for production of ERW steel pipe containing 0.01 to 0.35% by weight of C; 0.02 to 0.5% by weight of Si; 0.1 to 1.8% by weight of Mn; more than 0.005% to 0.05% by weight of Al; 0.0005 to 0.008% by weight of Ca; 0.001 to 0.015% by weight of Zr; not more than 0.015% by weight of P; and not more than 0.003% by weight of S; a ratio of Zr/Al or (Ti+Zr)/Al being less than 2 by weight; or further containing (A) at least one of 0.2 to 0.6% by weight of Cu, 0.1 to 1.0% by weight of Ni and 0.2 to 3.0% by weight of Cr, and/or (B) at least one of 0.10 to 1.0% by weight of Mo, 0.01 to 0.15% by weight of Nb, 0.005 to 0.10% by weight of Ti and 0.01 to 0.15% by weight of V; the balance being Fe and impurities as a steel material; and the steel pipe has a welding part in which the content of $Al_2O_3$ contained in inclusions at welding heat affected zone is not more than 50% by weight.

8 Claims, 3 Drawing Sheets

HIGHLY TOUGH ERW STEEL PIPE WITH DISTINGUISHED SOUR RESISTANCE

BACKGROUND OF THE INVENTION

1. Technical Field

This invention relates to a highly tough, ERW steel pipe having a high sour resistance, and more particularly to an ERW steel pipe (which means an electric-resistance-welded pipe or tube) having a high cracking resistance even under an environment containing wet hydrogen sulfide, for example, in drilling for or transportation of petroleum and natural gas, and also having a distinguished low temperature toughness.

2. Description of the Prior Art

The recently produced petroleum and natural gas very often contain hydrogen sulfide, and in the presence of sea water, fresh water, etc. at the same time corrosition takes place not only on the steel pipe surface to reduce the pipe wall thickness, but also the hydrogen generated on the steel pipe surface due to the corrosion may diffuse into the steel body to break the steel pipe. This has been a problem. The breakage is different from the stress cracking by sulfides which has been observed in high tensile steel since early times, from the viewpoint that the breakage has been observed to occur without any additional stress from the outside.

The hydrogen diffused from the environment circumulates at the boundaries between the steel matrix and inclusions such as MnS existing in the matrix and extended long in the rolling direction, and it is gasified in the steel matrix and the breakage occurs due to the resulting elevated hydrogen gas pressure. Inclusions such as MnS act as sharp notches, and these develop into cracks in parallel to the plate surface as crack nuclei. The cracks in parallel to the plate surface are connected to one another in the plate thickness direction. This kind of cracks will be hereinafter referred to as "hydrogen induced cracking".

Various researches have been so far made on steel of high resistance to the hydrogen induced cracking, and various kinds of steel have been proposed, typical of which are utilizations of crack prevention by addition of Cu or Co., reduction in MnS by reducing sulfer content, fixation of S by addition earth elements, etc., as disclosed, for example, in Japanese Patent Publication No. 57-17065, Japanese Patent Publication No. 57-16184, etc. By virtue of these techniques, steel capable of withstanding a considerably severe environment has been made available up to now.

A seam welded steel pipe is produced by forming a steel plate such as hot coil, etc. and seam welding the shaped steel plate at the edge parts, and its essential difference from a steel plate is, needless to say, in the presence of a welded part and heat affected zone. There have been substantially no examples of investigation of the sour resistance at the weld and heat affected zone, because in the ordinary process inclusions such as MnS extending in the rolling direction exist to a large extent at the inverse V segregation parts in the case of large size ingots and at the center segregation parts in the case of continuously cast slab, and hardly exist at the edge parts of steel plates, and thus it has been common knowledge that the so called single hoop pipe produced by welding a steel plate at the edge parts to join one edge part with another has a good sour resistance at the weld and heat affected zone.

On the other hand, in the case of the so called coil-splitted ERW pipe production by dividing a hot coil into at least two strips in the width direction, and by electric-resistance-welding the strips, parts highly sensitive to a hydrogen induced cracking such as inverse V segregation parts and center segregation parts locate at one side or both sides of the weld and thus there has been the recognition of the hydrogen induced cracking. However, in this case, the same steps as those for the matrix such as reduction in inclusions such as MnS and the microsegregation of Mn, P and the like have also been taken in principle so far.

As an extensive study of the sour resistance at the weld of an ERW steel pipe, one of the present inventors found and disclosed in Japanese Patent Application Kokai (Laid-Open) No. 61-124554 corresponding to U.S. patent application Ser. No. 799978 filed on Nov. 20, 1985 that, even when there are no inclusions such as MnS extended long in the rolling direction, hydrogen induced cracking sometimes occur at the weld, and the hydrogen induced cracking occurs as cracks perpendicular to the plate surface at the weld, which differs from the cracks occuring in the base metal. Furthermore, one of the present inventors found that the hydrogen induced cracking occurs even at the single hoop pipe of essentially less microsegregation at the edge parts of a steel plate. These cracks had never been disclosed and are a problem as important as or more important than those of the hydrogen induced cracking in parallel to the plate surface of the base material. Furthermore, it was found that this cracking occurs even at the ERW pipes of steel for which the conventional steel making process is not be prevented by the conventional techniques.

Tbe production areas of petroleum and natural gas have a been recently extended over to extremely cold areas such as Alaska, USSR, and the Arctic Ocean, and line pipes for use in these areas require a distinguished low temperature toughness in the base material and also at the weld. When the fluid products contain hydrogen sulfide, it is needless to say that a sour resistance is required in addition to the low temperature toughness.

In the ERW steel pipe, the toughness is lower at the welded part than in the base material, and various researches have been so far made on the production of ERW steel pipes having a distinguished toughness even at the weld. Various methods and steel pipes have been thus far proposed, typical of which are utilizations of tough materials obtained by controlling the finishing temperature and the coiling temperature in the hot rolling process, control of grain size by limitation of the cooling speed in a seam weld heat treatment, reduction of N in solid solution, refining the grain size by the addition of Nb or V, etc., as disclosed, for example, in Japanese Patent Application Kokai (Laid-Open) No. 54-136512, Japanese Patent Application Kokai (Laid-Open) No. 57-140823, Japanese Patent Publication No. 58-53707, Japanese Patent Publication No. 58-53708, etc. ERW steel pipes having a considerably distinguished toughness have been made available up to now according to these techniques.

However, these ERW steel pipes are destined to use in a noncorrosive environment, and their use in the so-called sour environment containing hydrogen sulfide or water has not been taken into account.

As a result of extensive studies also on the toughness of the welds of ERW steel pipes, one of the present inventors found that the toughness sour-resistant ERW steel pipes is considerably more deteriorated at the welds than in the base material, and that this problem could not be solved according to any of the foregoing prior art techniques.

As a result of further studies to develop a steel pipe having a high toughness and high resistance to quite a new type of hydrogen induced cracking, that is, a cracking perpendicular to the plate surface, Miyasaka found (see Japanese Patent Application Kokai No. 62-170458) that a cause for the hydrogen induced cracking and the reduction in toughness at the weld of an ERW steel pipe 1 schematically shown in FIG. 1 is flattened inclusions of oxides existing at a weld 2 and welding heat affected zone 3 on both sides $Z_1$ and $Z_2$ thereof within a distance of 500 μm each from the weld 2.

Furthermore, he found that, among these flattened inclusions of oxides, those inclusions whose shapes, as viewed in the cross-section within the distance of $Z_1=Z_2=500$ μm at both sides of the weld 2 shown in FIG. 1, have a ratio of more than 2 between the length in the through thickness direction and the length in the circumferential direction and whose major axis is 2 μm or longer, act as nuclei for the generation of hydrogen induced cracking, and when those inclusions whose shapes have a ratio of more than 2 between the length in the through thickness direction and the length in the circumferential direction and when 5 or more inclusions of the oxides having a major axis of 2 μm or longer are included in the cross-section of 1 $mm^2$, the hydrogen induced cracks generated as nuclei join one another and develop into macroscopic cracks.

According to further studies made by one of the present inventors, it was found that these flattened inclusions of oxides are complex oxides composed of Ca and Al as the main components, and that the inclusions of oxides existing in the base material advance in a nearly spherical shape are heated nearly up to the melting point of the steel during the seam welding, compressed from both sides by the squeeze rolls and thus deformed into a flattened form.

On the basis of the foregoing findings, one of the present inventors proposed a steel for production of ERW steel pipe having a distinguished sour resistance and toughness in the base material and also at the weld by decreasing the content of Al, so far admixed mainly for the purpose of deoxidation, to a minimum and adding Ti or Zr thereto as a deoxidizing element,-as in Japanese Patent Application Kokai (Laid-Open) No. 61-124554 corresponding to U.S. patent application Ser. No. 799978 and Japanese Patent Application Kokai (LaidOpen) No. 62-170458.

The Japanese Patent Application Kokai (Laid-Open) No. 61-124554 discloses the steel for production of a highly tough, ERW steel pipe having a distinguished sour resistance which is characterized by containing 0.01 to 0.35% by weight of C; 0.02 to 0.5% by weight of Si; 0.1 to 1.8% by weight of Mn; 0.0005 to 0.008% by weight of Ca; 0.006 to 0.2% in total by weight of at least one of Ti and Zr; not more than 0.005% by weight of Al; not more than 0.015% by weight of P; and not more than 0.003% by weight of S; or further containing (A) at least one of 0.2 to 0.6% by weight of Cu, 0.1 to 1.0% by weight of Ni, and 0.2 to 3.0% by weight of Cr, and/or (B) at least one of 0.10 to 1.0% by weight of Mo, 0.01 to 0.15% by weight of Nb and 0.01 to 0.15% by weight of V; the balance being Fe and impurities. Thus, the Al content of the steel is not more than 0.005% by weight.

The Japanese Patent Application Kokai (Laid-Open) No. 62-170458 was laid-open to the public on July 27, 1987 and discloses a steel for production of a highly tough, ERW steel pipe having a distinguished sour resistance which is characterized by containing 0.01 to 0.35% by weight of C; 0.02 to 0.5% by weight of Si; 0.1 to 1.8% by weight of Mn; more than 0.005% to 0.05% by weight of Al; 0.0005 to 0.008% by weight of Ca; 0.01 to 0.2% in total by weight of at least one of Ti and Zr; not more than 0.015% by weight of P; and not more than 0.003% by weight of S; Ti/Al, Zr/Al or (Ti+Zr)-/Al being 2 or more by weight; or further containing (A) at least one of 0.2 to 0.6% by weight of Cu, 0.1 to 1.0% by weight of Ni, and 0.2 to 3.0% by weight of Cr, and/or (B) at least one of 0.10 to 1.0% by weight of Mo, 0.01 to 0.15% by weight of Nb and 0.01 to 0.15% by weight of V; the balance being Fe and impurities. And particularly the steel has Ti/Al, Zr/Al or (Ti+Zr)/Al of 2 or more by weight when the Al content is high, e.g. in a range of more than 0.005% to 0.05% by weight, and it contains Ti and Zr as main deoxidizing elements in place of Al to prevent formation of inclusions susceptible to deformation during the seam welding.

SUMMARY OF THE INVENTION

The desired sour resistance and toughness of steel are to be obtained in the Japanese Patent Application Kokai (Laid-Open) No. 62-170458 when the content of Ti or Zr to be added thereto as the deoxidizing element and the content of Al contained in the steel are in such a relationship that Ti/Al, Zr/Al or (Ti+Zr)/Al is 2 or more by weight under the limitation that the content of Al is more than 0.005% by weight. As a result of further extensive studies, the present inventors have found that, when Ti, Zr or Ti+Zr are added thereto while satisfying the foregoing relationship in the case that the content of Al is in a range of more than 0.005% to 0.05% by weight, a large amount of carbides or nitrides of Ti or Zr is formed in the steel during the casting and rolling, resulting in considerable deterioration of the toughness in the base material. Furthermore, the present inventors have found that, when the steel contains more than 0.005% by weight of Al, appropriately adding at least 0.001% by weight of Zr thereto as the deoxidizing element is satisfactory and steel for production of ERW steel pipe giving distinguished sour resistance and toughness can be produced by controlling an appropriate component system of oxides as well as the steel.

There have been substantially no examples of using Zr as the main deoxidizing agent. Japanese Patent Application Kokai (Laid-Open) No. 59-53656 discloses steel containing not more than 0.10% by weight of Zr as steel for high strength line pipes having a distinguished resistance to cracking induced by hydrogen, where Zr is used to increase the strength and the deoxidation to control the oxygen content of the steel is carried out solely by Al. Thus, no limitation is made at all to the composition of the inclusions at the welding heat affected zone, and consequently a large amount of inclusions having a high $Al_2O_3$ content is formed at the heat affected zone and thus the cracking perpendicular to the plate surface induced by hydrogen cannot be prevented. A process for producing a highly tough hot coil of extremely low carbon content having a distinguished resistance to cracking induced by hydrogen and containing 0.01 to 0.1% by weight of Zr is proposed in Japanese Patent application Kokai (Laid-open) No. 58-1015, where Zr is added thereto to react with S in the steel, thereby controlling the form of sulfides, and the element that conducts the deoxidation is Al also in this case. Thus, the inclusions at the welding heat affected zone contain a large amount of $Al_2O_3$ and it is quite impossible to prevent cracking perpendicular to the plate surface induced by hydrogen.

The present invention has been established to overcome the foregoing disadvantages so far encountered, that is, reduction in the toughness at the weld, and hydrogen induced cracking perpendicular to the plate surface at the weld,caused by flattened inclusions of oxides existing at the welding heat affetted zone, and an object of the present invention is to control the composition of oxides in the steel by adding Zr thereto as a deoxidizing element and to provide steel for production of ERW steel pipe having distinguished sour resistance and toughness.

The present inventors have found that, even if $Al_2O_3$ is inevitably contained in inclusions as a result of entraining of $Al_2O_3$ from slag, reduction of $Al_2O_3$ in the refractories, or mechanical attrition of refractories in the case that no Al is added to the steel for the deoxidation purpose, and even if the content of Al in the steel exceeds 0.005% by weight as a result of its equilibrium reaction, or even if Al is intentionally added thereto to supplement the deoxidation by Zr and the content of Al in the steel exceeds 0.005% by weight, steel for production of ERW steel pipe having a much distinguished low temperature toughness at the weld and a much distinguished toughness in the base material can be produced, so long as a ratio of the content of Zr to be added to that of Al in the steel is less than 2 by weight, the content of Zr is 0.001% by weight or more, and the content of $Al_2O_3$ in the inclusions the welding heat affected zone is not more than 50% by weight.

The present invention is based on the foregoing findings and provides a highly tough, ERW steel pipe having a distinguished sour resistance, characterized by being prepared from steel for production of ERW steel pipe containing 0.01 to 0.35% by weight of C; 0.02 to 0.5% by weight of Si; 0.1 to 1.8% by weight of Mn; more than 0.005% to 0.05% by weight of Al; 0.0005 to 0.008% by weight of Ca; 0.001 to 0.015% by weight of Zr; not more than 0.015% by weight of P; and not more than 0.003% by weight of S; a ratio of Zr/Al or (Ti+Zr)/Al being less than 2 by weight; or further containing (A) at least one of 0.2 to 0.6% by weight of Cu, 0.1 to 1.0% by weight of Ni and 0.2 to 3.0% by weight of Cr, and/or (B) at least one of 0.10 to 1.0% by weight of Mo, 0.01 to 0.15% by weight of Nb, 0.005 to 0.10% by weight of Ti and 0.01 to 0.15% by weight of V; the balance being Fe and impurities as a steel material; and by having a welding part in which the content of $Al_2O_3$ contained in inclusions at the welding heat affected zone is not more than 50% by weight.

DETAILED DESCRIPTION OF THE PREFERRED EMBODIMENT

Figure 1:
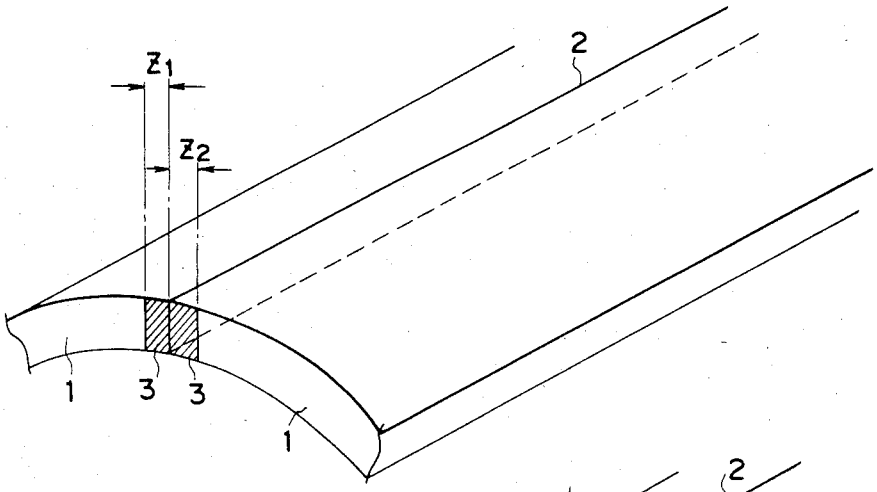
FIG. 1 is a schematic view showing a weld of an ERW steel pipe and a region in which inclusions of oxides formed in a flattened form exist at both sides of the weld.

The present invention will be described in detail below.

Reasons for limiting the ranges of the respective components, as given above, in the present invention will be explained at first.

C is a basic element for obtaining the strength of steel most stably, and it is necessary to contain at least 0.01% by weight of C for assuring the strength, but above 0.35% by weight the toughness of steel is adversely influenced. Thus, 0.01 to 0.35% by weight of C has been selected.

Si is an element or increasing the strength, and at least 0.02% by weight of Si should be contained, but the upper limit must be 0.5% by weight for assuring the toughness.

Mn is a necessary element for the strength, and at least 0.1% by weight of Mn must be contained, but the upper limit content must be 1.8% by weight for assuring the weldability and the toughness.

Furthermore, Ca is a very effective element for improving the sour resistance of base material owing to its fixation of S in steel as CaS and the resulting prevention of MnS formation, and at least 0.0005% by weight of Ca must be contained to assure the sour resistance of the base material,but above 0.008% by weight thereof large inclusions composed of CaS-CaO as main components will be formed. Thus, the upper limit content must be 0.008% by weight.

Zr is an important element for use in deoxidation as a substitute for Al, and below 0.001% by weight the deoxidation ability will be lost when the Al content exceeds 0.005% by weight, whereas above 0.015% by weight the toughness of steel will be lowered. Thus, the content of Zr must be 0.001 to 0.015% by weight. When a ratio of Zr/Al is less than 2 by weight, the matrix can have a good toughness, and the foregoing effect can be also obtained. Thus the Zr content must be selected in view of the above defined range of ratio to the Al content in the steel.

As a result of detailed investigation of steel pipe cross-sections, hydrogen induced cracking, and the fractography of impact test specimens, the present inventors have found that in the case of deoxidation by Zr the complex oxides composed of Ca and Zr as main components are very hardly deformed during the welding. This finding is also a reason for adding Zr to the steel in the present invention.

The smaller the Al content, the better, because Al can be combined with Ca and 0 to form inclusions readily susceptible to deformation, but when Al is inevitably introduced from the refractories, slag, etc. during the casting and refining of steel or when Al is added to supplement incomplete deoxidation, its content often exceeds 0.005% by weight. When the Al content exceeds 0.005% by weight as above, a ratio of Zr/Al must be made less than 2 by weight by adjusting the contents of the individual components so as not to deteriorate the toughness of the matrix. Formation of inclusions readily susceptible to deformation during the welding can be completely suppressed thereby, and steel for production of ERW steel pipe having a god toughness in the base material can be obtained. When the Al content exceeds 0.05% by weight, large inclusions composed mainly of $Al_2O_3$ are readily formed, and the $Al_2O_3$ content in the inclusions exceeds 50% by weight, lowering the toughness in the base material and precipitate oxides including $Al_2O_3$ on the continuous casting immersion nozzle, etc., resulting in a high possibility of clogging nozzle. Thus, the upper limit must be 0.05% by weight.

P is an element capable of readily propagating the hydrogen induced cracking in the matrix, and the P content must be not more than 0.015% by weight.

S combines with Mn to form MnS causing the hydrogen induced cracking in the base material, and thus the S content must be suppressed to not more than 0.003% by weight for assuring the sour resistance in the base material.

The reason for limiting a ratio of Zr/Al to less than 20 by weight is based on the following test.

Basic components of the steel used in the following test are 0.03 to 0.11% by weight of C; 0.06 to 0.35% by weight of Si; 0.61 to 1.62% by weight of Mn; 0.005 to 0.010% by weight of P; 0.0002 to 0.0027% by weight of S; and 0.0009 to 0.0042% by weight of Ca, and the steel was tested on the influences of Zr and Al upon the sour resistance and the toughness. The steel was melted in an ordinary smelting process and hot rolled into a steel sheet, 11 mm in thickness, and the steel sheet was subjected to welding according to the ordinary process to make an ERW steel pipe. Seam normalization was applied to the weld at a peak temperature of 950° to 1,020° C.

Figure 2:
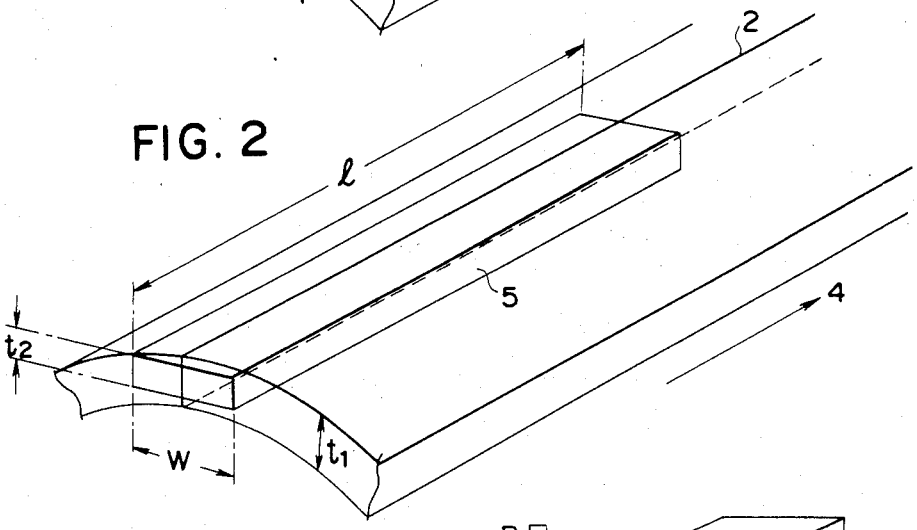
FIG. 2 is a view showing an outline of sampling a test piece.

As outlined in FIG. 2, a test piece 5 (thickness $t_2=9$ mm, width $W=20$ mm and length $l=100$ mm) including the weld of the steel pipe (wall thickness $t_1=11$ mm) was machined from the ERW steel pipe, and evaluated for sour resistance. The arrow 4 in FIG. 2 shows a welding direction. Another test piece of the same dimensions, shape, and sampling direction was machined from the base material itself and evaluated for sour resistance.

The evaluation test of the sour resistance was carried out by immersing the test piece into an aqueous 5% NaCl solution saturated with $H_2S$ and admixed with 0.5% $CH_3COOH$ at the temperature of 25° C. and pH 2.8-3.8 for 96 hours and determining the formation of cracks. As outlined in FIG. 3 the cracking was identified by subjecting the test piece containing the weld to ultrasonic inspection with respect to two cross-sections of the test piece 5 and then to microscopic inspection of the cross-sections.

Figure 3:
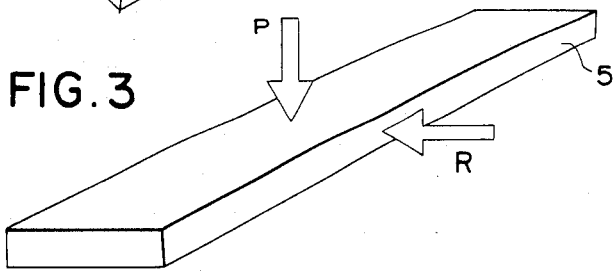
FIG. 3 is a view showing directions of ultrasonic inspection.

In FIG. 3, the arrow P shows the ultrasonic inspecting direction destined for the cracking in parallel to the plate surface and the arrow R shows the ultrasonic inspecting direction destined for the cracking perpendicular to the plate surface. The sample taken from the base material itself was subjected to ultrasonic inspection only in the direction of the arrow P in FIG. 3.

On the other hand, the toughness was evaluated by sampling a test piece according to JIS No. 4 from ERW steel pipe in the transverse direction, providing a notch at the base material or the weld, and measuring the toughness in base material and a difference ΔvTrs in the fracture appearance transition temperature between the base material and the weld (=vTrs of the base material−vTrs of the weld).

Figure 4:
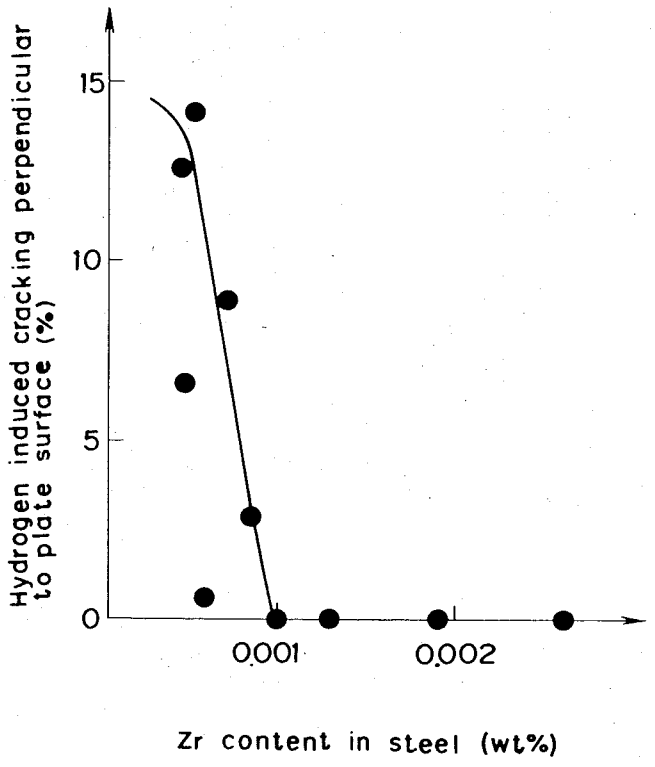
FIG. 4 is a diagram showing a relationship between the Zr content in steel and the area ratio of hydrogen induced cracking perpendicular to the plate surface.

FIG. 4 is a diagram showing a relationship between the Zr content and the area ratio of hydrogen induced cracking perpendicular to the plate surface. It can be seen therefrom that, with increasing Zr content, the area ratio of hydrogen induced cracking perpendicular to the plate surface is considerably reduced and it can be substantially zero above 0.001% by weight of Zr.

Figure 5:
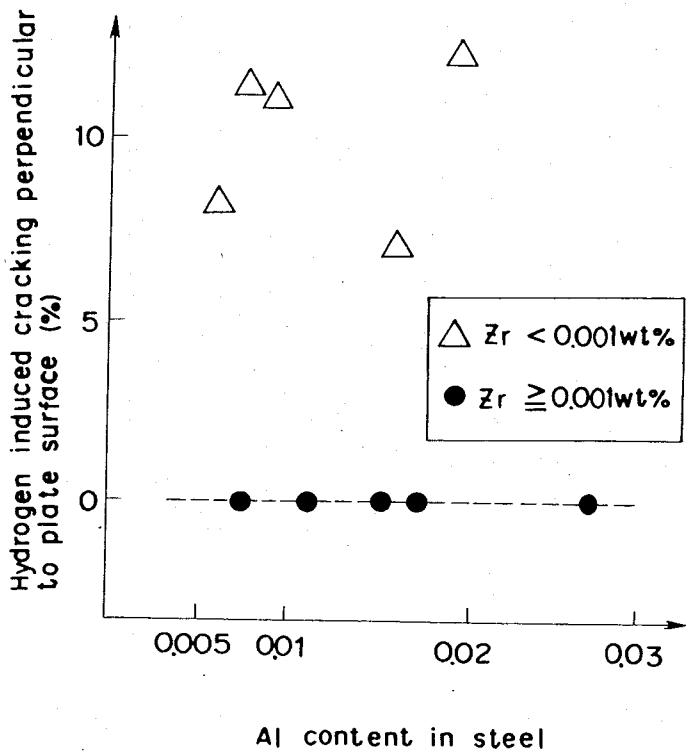
FIG. 5 is a diagram showing a relationship between the Al content in steel and the area ratio of hydrogen induced cracking perpendicular to the plate surface.

FIG. 5 is a diagram showing a relationship between the Al content in steel and the area ratio of hydrogen induced cracking perpendicular to the plate surface. As is obvious from FIG. 5, the area ratio of hydrogen induced cracking perpendicular to the plate surface is zero even in a ratio of $Zr/Al<2$, irrespectively of the Al content in steel, so long as $Zr\geqq0.001\%$ by weight, and a good sour resistance can be stably obtained. The area ratio of hydrogen induced cracking in parallel to the plate surface is not more than 5% at the weld and also in the base material.

Figure 6:
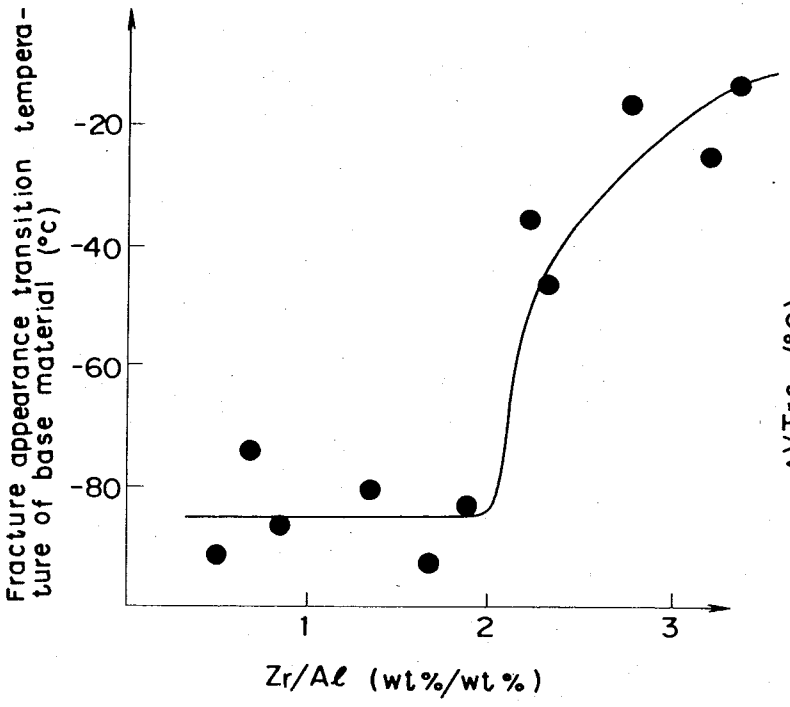
FIG. 6 is a diagram showing a relationship between a ratio of Zr/Al and the fracture transition temperature of base material.

FIG. 6 is a diagram showing a relationship between the ratio of Zr/Al and the fracture appearance transition temperature of base material. As is obvious from FIG. 6, the value of vTrs is increased with increasing ratio of Zr/Al, deteriorating the toughness, and when the ratio of Zr/Al is less than 2 by weight, the value of vTrs is suddenly lowered, and steel having a good toughness in the base material can be obtained.

Figure 7:
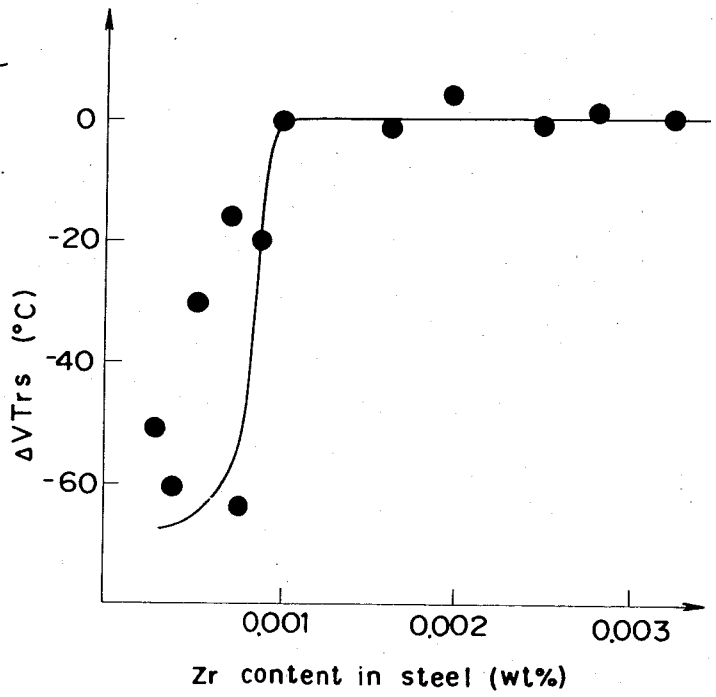
FIG. 7 is a diagram showing a relationship between the Zr content in steel and a difference in fracture transition temperature ΔvTrs.

FIG. 7 is a diagram showing a relationship between the Zr content and the difference ΔvTrs in fracture appearance transition temperature. As is obvious from FIG. 7, ΔvTrs is substantially zero above 0.001% by weight of Zr, but is considerably reduced below 0.001% by weight of Zr. This means that vTrs at the weld is considerably increased, as compared with vTrs in the base material when $Zr<0.001\%$ by weight. That is, a high toughness can be obtained stably, irrespectively of the Al content, so long as the steel contains not less than 0.001% by weight of Zr.

Combined characteristics, that is, a distinguished sour resistance in the base material and at the weld and a high toughness, can be satisfied by controlling the Zr content so that a ratio of Zr/Al may be less than 2 by weight and making the Zr content at least 0.001% by weight, as described above.

The foregoing relates to the basic components of the present invention, and in the present invention (A) at least one of Cu, Ni and Cr and/or (B) at least one of Mo, V, Ti and Nb can be contained, depending upon the individual uses.

Cu, Ni and Cr are each effective for increasing the corrosion resistance of the base material and reducing the amount of hydrogen to be diffused into the steel.

Less than 0.20% by weight of Cu is not effective, whereas more than 0.60% by weight of Cu has an adverse effect on the hot workability. Thus, the Cu content must be in a range of 0.20 to 0.60% by weight.

Less than 0.1% by weight of Ni is not effective, whereas more than 1.0% by weight of Ni may result in stress cracking due to the sulfide. The Ni content must be in a range of 0.1 to 1.0% by weight. Ni can be added to steel in the foregoing range together with Cu to prevent hot brittleness due to Cu.

Less than 0.2% by weight of Cr is not effective, whereas more than 3.0% by weight of Cr lowers the toughness of steel. Thus, the Cr content must be in a range of 0.2 to 3.0% by weight. Cr can be also used as an element capable of increasing the strength and toughness by its addition to steel having a Mn content of less than 0.6% by weight to prevent the formation of MnS. Cr can be added to any other steel to increase the strength and toughness.

Mo, V, Ti and Nb are all elements capable of increasing the strength of steel, and equivalent effects on increase in the strength can be obtained by adding 0.10% by weight or more of Mo, 0.005% by weight or more of Ti, or 0.01% by weight or more of Nb or V, whereas more than 1.0% by weight of Mo, more than 0.1% by weight of Ti, or more than 0.15% by weight of Nb or V may result in lowering the toughness. Thus, the Mo content must be in a range of 0.10 to 1.0% by weight, the Ti content in a range of 0.005 to 0.1% by weight, a ratio of (Ti+Zr)/Al less than 2 by weight and the Nb or V content in a range of 0.01 to 0.15% by weight.

The foregoing alloy components may be added alone or together.

Inclusions in steel resulting from deoxidation by Zr and addition of Ca include $ZrO_2$ as a deoxidation product, CaO or CaS produced by addition of Ca, complex oxides composed mainly of $Al_2O_3$, etc. and sulfides resulting from contamination from the refractories or from auxiliary deoxidation. Among these inclusions, the inclusion component that inhibits the effect of the present invention is $Al_2O_3$ that can form a compound of low melting point, and the reduction of the $Al_2O_3$ compound is the greatest feature of the present invention. As a result of detailed studies, the present inventors have found that, when the $Al_2O_3$ content in the inclusions at the heat affected zone exceeds 50% by weight, most of inclusion components are converted to complex oxides which are composed mainly of Ca and Al, have low melting points and are very readily deformed into flattened forms. This is the reason for limiting the $Al_2O_3$ content in the inclusions at the heat affected zone to not more than 50% by weight. Thus, the lower the $Al_2O_3$ content, the better.

In the present steel, more than 0.010% by weight of N as an impurity creates a welding problem and is not preferable, and not more than 0.010% by weight of N has no considerable influence upon the quality of steel, but the lower the N content, the better, when the influence upon the strain aging, toughness at the welded peripheral part, etc. are taken into account. On the other hand, the O content is not more than 0.010% by weight so that most of Ca may be effectively utilized for fixing S without conversion to oxides, and the lower the O content, the better.

In the present invention, Ca is added to steel for for fixing S than Ca, for example, rare earth metals (REM) including Y, alkali and alkaline earth metals such as Mg, Ba, etc. can be used alone or together with Ca.

Steel for production of ERW steel pipe according to the present invention can be produced only by hot rolling or by hot rolling including a successive controlled cooling step or further steps including normalization, tempering or hardening-tempering, or the like of the rolled steel, as applied to the ordinary steel material. , Furthermore, a part of or the entire ERW steel pipe can be subjected to a step of normalization, tempering or hardening-tempering or a processing-heat treatment such as hot drawing, etc. after pipe formation.

Application of any or a plurality of the steps can be selected in view of the required characteristics such as strength, toughness, etc.

The present invention is characterized by controlling the inclusions at the heat affected zone to a low $Al_2O_3$ content, which can be attained only by carrying out the deoxidation by Zr before the addition of Ca. When the deoxidation by Zr is carried out after the addition of Ca, a large number of the inclusions, which have low melting points and that include Ca and Al as main components, are formed at the heat affected zone, so that the $Al_2O_3$ content in the inclusions at the zone exceeds 50% by weight.

One object of using Zr in the deoxidation in the present invention is to lower the oxygen content in the molten steel and allow the added Ca to effectively fix S, and thus for the achievement of this object, the deoxidation by Zr must be also carried out before the addition of Ca. It s preferable to lower the oxygen content in the molten steel by vacuum treatment such as RH treatment, etc. after the addition of Zr. The oxygen content must be not more than 0.01% by weight, and the lower the oxygen content, the better.

The effect of the present invention will be described in detail below, referring to an Example.

(Working Example)

Steels having compositions shown in Table 1 were produced in the ordinary smelting process and hot rolled to steel plates, 12.7 mm in thickness. The steel plates were made into ERW steel pipes, 406 mm in outer diameter, according to the ordinary process, and evaluated for sour resistance in the same manner as described before. The results are shown also in Table 1.

As is obvious from Table 1, no hydrogen induced cracking occurred at the weld and in the base material in the present steel pipes, and the decrease in the toughness at the weld was very low, whereas in the reference steel pipes hydrogen induced cracking perpendicular to the plate surface occurred at the weld and vTrs was considerably increased at the weld, as compared with that in the base material, or vTrs was increased in the base material, and the toughness was considerably lowered in the base material or at the weld. Reference steel pipes No. 33 and 34 are examples of ERW steel pipes which were prepared from steels in which deoxidation by Zr was carried out after the addition of Ca, and satisfied the requirements of the present invention for the chemical composition but whose $Al_2O_3$ contents in the inclusions the welding heat-influenced parts exceeded 50% by weight, resulting in formation of the inclusions in a flattened form and deterioration of the low temperature toughness.

TABLE 1

| | | Chemical components wt % | | | | | | | | | | | | | | | |
|---|---|---|---|---|---|---|---|---|---|---|---|---|---|---|---|---|---|
| | Item | No. | C | Si | Mn | Cr | Ni | Mo | V | Ti | Nb | Cu | P | S | Ca | Al | Zr |
| Present steel pipe | (1) | 1 | 0.023 | 0.104 | 1.01 | — | — | — | — | — | — | — | 0.003 | 0.0003 | 0.0011 | 0.006 | 0.007 |
| | | 2 | 0.105 | 0.176 | 1.15 | — | — | — | — | — | — | — | 0.006 | 0.0006 | 0.0030 | 0.016 | 0.006 |
| | | 3 | 0.156 | 0.221 | 1.24 | — | — | — | — | — | — | — | 0.008 | 0.0005 | 0.0041 | 0.022 | 0.002 |
| | | 4 | 0.155 | 0.200 | 1.44 | — | — | — | — | — | — | — | 0.008 | 0.0005 | 0.0042 | 0.023 | 0.007 |

TABLE 1-continued

| | | | | | | | | | | | | | | | | |
|---|---|---|---|---|---|---|---|---|---|---|---|---|---|---|---|---|
| | | 5 | 0.075 | 0.149 | 1.09 | — | — | — | — | — | — | — | 0.005 | 0.0008 | 0.0038 | 0.020 | 0.014 |
| | (2) | 6 | 0.139 | 0.206 | 1.21 | — | — | — | — | — | — | 0.33 | 0.008 | 0.0008 | 0.0026 | 0.013 | 0.012 |
| | | 7 | 0.140 | 0.207 | 1.21 | — | 0.42 | — | — | — | — | — | 0.008 | 0.0007 | 0.0038 | 0.021 | 0.013 |
| | | 8 | 0.131 | 0.199 | 1.20 | 0.25 | — | — | — | — | — | — | 0.007 | 0.0008 | 0.0036 | 0.019 | 0.007 |
| | | 9 | 0.072 | 0.146 | 1.09 | — | 0.26 | — | — | — | — | 0.40 | 0.008 | 0.0005 | 0.0040 | 0.022 | 0.013 |
| | | 10 | 0.149 | 0.215 | 1.23 | 0.24 | — | — | — | — | — | 0.44 | 0.005 | 0.0003 | 0.0022 | 0.013 | 0.005 |
| | | 11 | 0.040 | 0.117 | 1.04 | 0.29 | 0.25 | — | — | — | — | — | 0.003 | 0.0003 | 0.0015 | 0.008 | 0.003 |
| | | 12 | 0.037 | 0.115 | 1.03 | 0.27 | 0.19 | — | — | — | — | 0.37 | 0.003 | 0.0003 | 0.0014 | 0.008 | 0.015 |
| | (3) | 13 | 0.029 | 0.108 | 1.01 | — | — | 0.25 | — | 0.012 | — | — | 0.003 | 0.0006 | 0.0012 | 0.017 | 0.002 |
| | | 14 | 0.105 | 0.175 | 1.15 | — | — | — | — | 0.009 | 0.144 | — | 0.006 | 0.0004 | 0.0029 | 0.016 | 0.010 |
| | | 15 | 0.055 | 0.131 | 1.06 | — | — | — | — | 0.016 | 0.049 | — | 0.004 | 0.0005 | 0.0018 | 0.030 | 0.008 |
| | | 16 | 0.073 | 0.148 | 1.10 | — | — | — | 0.139 | 0.007 | — | — | 0.005 | 0.0004 | 0.0022 | 0.012 | 0.007 |
| | | 17 | 0.055 | 0.131 | 1.06 | — | — | — | 0.055 | 0.022 | — | — | 0.004 | 0.0004 | 0.0014 | 0.018 | 0.010 |
| | | 18 | 0.089 | 0.162 | 1.12 | — | — | 0.31 | — | 0.019 | 0.037 | — | 0.005 | 0.0005 | 0.0026 | 0.024 | 0.009 |
| | | 19 | 0.037 | 0.115 | 1.03 | — | — | 0.23 | 0.046 | — | — | — | 0.005 | 0.0004 | 0.0014 | 0.008 | 0.010 |
| | | 20 | 0.091 | 0.164 | 1.13 | — | — | — | 0.053 | 0.012 | 0.027 | — | 0.003 | 0.0008 | 0.0027 | 0.023 | 0.015 |
| | | 21 | 0.079 | 0.152 | 1.10 | — | — | 0.29 | 0.048 | — | 0.033 | — | 0.009 | 0.0008 | 0.0024 | 0.014 | 0.004 |
| | (4) | 22 | 0.087 | 0.160 | 1.12 | — | — | 0.26 | — | 0.015 | — | 0.34 | 0.008 | 0.0011 | 0.0026 | 0.014 | 0.007 |
| | | 23 | 0.047 | 0.124 | 1.05 | — | 0.31 | — | — | 0.017 | 0.040 | — | 0.010 | 0.0008 | 0.0016 | 0.019 | 0.011 |
| | | 24 | 0.084 | 0.157 | 1.11 | 1.24 | — | 0.17 | 0.056 | 0.011 | 0.041 | 0.43 | 0.011 | 0.0010 | 0.0024 | 0.014 | 0.007 |
| | | 25 | 0.021 | 0.101 | 1.00 | 0.30 | 0.22 | 0.98 | — | — | — | — | 0.009 | 0.0009 | 0.0010 | 0.006 | 0.006 |
| | | 26 | 0.159 | 0.224 | 1.25 | 2.33 | — | 0.24 | 0.048 | 0.029 | 0.029 | — | 0.007 | 0.0004 | 0.0042 | 0.022 | 0.005 |
| Reference steel pipe | | 27 | 0.078 | 0.152 | 1.10 | — | — | — | — | — | — | — | 0.005 | 0.0011 | 0.0024 | 0.013 | — |
| | | 28 | 0.041 | 0.119 | 1.04 | — | — | — | — | 0.016 | — | — | 0.006 | 0.0009 | 0.0015 | 0.008 | — |
| | | 29 | 0.155 | 0.220 | 1.24 | — | — | — | 0.057 | 0.060 | 0.040 | 0.23 | 0.004 | 0.0015 | 0.0041 | 0.022 | — |
| | | 30 | 0.157 | 0.222 | 1.81 | 0.22 | — | — | — | — | — | — | 0.003 | 0.0007 | 0.0042 | 0.023 | 0.076 |
| | | 31 | 0.051 | 0.247 | 1.18 | 2.21 | — | 0.18 | — | — | 0.041 | — | 0.004 | 0.0011 | 0.0018 | 0.024 | — |
| | | 32 | 0.048 | 0.197 | 1.41 | — | — | — | 0.046 | 0.086 | 0.037 | — | 0.009 | 0.0046 | 0.0021 | 0.011 | — |
| | | 33 | 0.052 | 0.255 | 1.30 | — | — | — | — | 0.012 | — | — | 0.007 | 0.0009 | 0.0033 | 0.013 | 0.007 |
| | | 34 | 0.067 | 0.184 | 1.18 | — | — | — | — | — | 0.036 | — | 0.006 | 0.0011 | 0.0042 | 0.014 | 0.006 |

| Chemical components | Item | No. | $Al_2O_3$ content at heat affected zone (%) | Weld: Area ratio of hydrogen induced cracking perpendicular to the plate surface (%) | Weld: Area ratio of hydrogen induced cracking in parallel to the plate surface (%) | Base material: Area ratio of hydrogen induced cracking in parallel to the plate surface (%) | ΔvTrs* (°C.) | vTrs in base material (°C.) | Zr/Al | (Ti + Zr)/Al |
|---|---|---|---|---|---|---|---|---|---|---|
| | | | wt % | | | | | | | |
| Present steel pipe | (1) | 1 | 27.1 | 0 | 0 | 0 | +3 | −72 | 1.167 | — |
| | | 2 | 5.2 | 0 | 0 | 0 | −1 | −60 | 0.375 | — |
| | | 3 | 16.3 | 0 | 0 | 0 | −2 | −81 | 0.091 | — |
| | | 4 | 17.1 | 0 | 0 | 0 | −1 | −79 | 0.304 | — |
| | | 5 | 15.2 | 0 | 0 | 0 | −3 | −62 | 0.700 | — |
| | (2) | 6 | 19.9 | 0 | 0 | 0 | −1 | −64 | 0.923 | — |
| | | 7 | 8.9 | 0 | 0 | 0 | 0 | −70 | 0.619 | — |
| | | 8 | 2.6 | 0 | 0 | 0 | −1 | −66 | 0.368 | — |
| | | 9 | 0.3 | 0 | 0 | 0 | 0 | −67 | 0.591 | — |
| | | 10 | 22.5 | 0 | 0 | 0 | 0 | −88 | 0.385 | — |
| | | 11 | 21.1 | 0 | 0 | 0 | −4 | −62 | 0.375 | — |
| | | 12 | 44.5 | 0 | 0 | 0 | −1 | −67 | 1.875 | — |
| | (3) | 13 | 31.0 | 0 | 0 | 0 | −1 | −69 | — | 0.824 |
| | | 14 | 8.1 | 0 | 0 | 0 | +1 | −63 | — | 1.188 |
| | | 15 | 8.8 | 0 | 0 | 0 | +1 | −56 | — | 0.800 |
| | | 16 | 7.9 | 0 | 0 | 0 | −1 | −65 | — | 1.167 |
| | | 17 | 16.6 | 0 | 0 | 0 | 0 | −84 | — | 1.778 |
| | | 18 | 31.4 | 0 | 0 | 0 | 0 | −70 | — | 1.167 |
| | | 19 | 21.9 | 0 | 0 | 0 | −2 | −80 | 1.250 | — |
| | | 20 | 19.8 | 0 | 0 | 0 | 0 | −71 | — | 1.174 |
| | | 21 | 15.5 | 0 | 0 | 0 | +2 | −95 | 0.286 | — |
| | (4) | 22 | 10.0 | 0 | 0 | 0 | +2 | −101 | — | 1.571 |
| | | 23 | 9.7 | 0 | 0 | 0 | −3 | −65 | — | 1.474 |
| | | 24 | 0.8 | 0 | 0 | 0 | −1 | −60 | — | 1.286 |
| | | 25 | 1.7 | 0 | 0 | 0 | 0 | −65 | 1.000 | — |
| | | 26 | 32.4 | 0 | 0 | 0 | 0 | −85 | — | 1.545 |
| Reference steel pipe | | 27 | 61.3 | 18 | 2 | 3 | −42 | −60 | — | 0.000 |
| | | 28 | 54.4 | 16 | 3 | 6 | −51 | −10 | — | 2.000 |
| | | 29 | 72.9 | 10 | 1 | 9 | −38 | +20 | — | 2.727 |
| | | 30 | 23.5 | 14 | 0 | 4 | −66 | +18 | 3.304 | — |
| | | 31 | 56.6 | 11 | 0 | 2 | −59 | −70 | — | 0.000 |
| | | 32 | 85.1 | 3 | 7 | 42 | −13 | +23 | — | 7.818 |
| | | 33 | 61.7 | 17 | 0 | 1 | −32 | −67 | — | 1.462 |
| | | 34 | 75.6 | 22 | 0 | 0 | −41 | −71 | 0.429 | — |

*ΔvTrs = vTrs in base material − vTrs at weld

As is evident from the foregoing Example, the present invention can provide a highly tough, ERW steel pipe having a distinguished low temperature toughness, being free from any hydrogen induced cracking even under a severe environment of a low pH, and thus can greatly contribute to the development of the industry.

What is claimed is:

1. A highly tough, ERW steel pipe having improved sour resistance, having been prepared from steel consisting essentially of 0.01 to 0.35% by weight of C; 0.02 to 0.5% by weight of Si; 0.1 to 1.8% by weight of Mn; more than 0.005 to 0.05% by weight of Al; 0.0005 to 0.008% by weight of Ca; 0.001 to 0.015% by weight of Zr; not more than 0.015% by weight of P; not more than 0.003% by weight of S; a ratio of Zr/Al being less than 2 by weight; and the balance being Fe and impurities as a steel material; and having a welded slam in which the content of $Al_2O_3$ contained in inclusions at welding heat affected zone is not more than 50% by weight.

2. A highly tough, ERW steel pipe having improved sour resistance, having been prepared from steel consisting essentially of 0.01 to 0.35% by weight of C; 0.02 to 0.5% by weight of Si; 0.1 to 1.8% by weight of Mn; at least one of 0.2 to 3.0% by weight of Cr, 0.1 to 1.0% by weight of Ni and 0.2 to 0.6% by weight of Cu; more than 0.005 to 0.05% by weight of Al; 0.0005 to 0.008% by weight of Ca; 0.001 to 0.015% by weight of Zr; not more than 0.015% by weight of P; not more than 0.003% by weight of S; a ratio of Zr/Al being less than 2 by weight; and the balance being Fe and impurities as a steel material; and having a welded seam in which the content of $Al_2O_3$ contained in inclusions at welding heat affected zone is not more than 50% by weight.

3. A highly tough, ERW steel pipe having a improved sour resistance, having been prepared from steel consisting essentially of 0.01 to 0.35% by weight of C; 0.02 to 0.5% by weight of Si; 0.1 to 1.8% by weight of Mn; at least one of 0.10 to 1.0% by weight of Mo, 0.01 to 0.15% by weight of V, 0.005 to 0.10% by weight of Ti and 0.01 to 0.15% by weight of Nb; more than 0.005 to 0.05% by weight of Al; 0.0005 to 0.008% by weight of Ca; 0.001 to 0.015% by weight of Zr; not more than 0.015% by weight of P; not more than 0.003% by weight of S; a ratio of (Ti+Zr)/Al being less than 2 by weight; and the balance being Fe and impurities as a steel material; and having a welded seam in which the content of $Al_2O_3$ in inclusions at welding heat affected zone is not more than 50% by weight.

4. A highly tough, ERW steel pipe having improved sour resistance having been prepared from steel consisting essentially of 0.01 to 0.35% by weight of C; 0.02 to 0.5% by weight of Si; 0.1 to 1.8% by weight of Mn; at least one of 0.2 to 3.0% by weight of Cr, 0.1 to 1.0% by weight of Ni and 0.2 to 0.6% by weight of Cu; at least one of 0.10 to 1.0% by weight of Mo, 0.01 to 0.15% by weight of V, 0.005 to 0.10% by weight of Ti and 0.01 to 0.15% by weight of Nb; more than 0.005 to 0.05% by weight of Al; 0.0005 to 0.008% by weight of Ca; 0.001 to 0.015% by weight of Zr; not more than 0.015% by weight of P; not more than 0.003% by weight of S; a ratio of (Ti+Zr)/Al being less than 2 by weight; and the balance being Fe and impurities as a steel material; and having a welded seam in which the content of $Al_2O_3$ contained in inclusions at welding heat affected zone is not more than 50% by weight.

5. A steel pipe according to claim 1, wherein the content of C is more than 0.01 to 0.35% by weight.

6. A steel pipe according to claim 2, wherein the content of C is more than 0.01 to 0.35% by weight.

7. A steel pipe according to claim 3, wherein the content of C is more than 0.01 to 0.35% by weight.

8. A steel pipe according to claim 4, wherein the content of C is more than 0.01 to 0.35% by weight.

* * * * *

UNITED STATES PATENT AND TRADEMARK OFFICE

CERTIFICATE OF CORRECTION

PATENT NO. : 4,804,021

DATED : February 14, 1989

INVENTOR(S) : Yasushi HASEGAWA and Hiroyo HAGA

It is certified that error appears in the above-identified patent and that said Letters Patent is hereby corrected as shown below:

Column 13, line 12, change "slam" to --seam--;

and

Column 13, line 31, after "having" delete "a".

Signed and Sealed this

Thirtieth Day of April, 1991

*Attest:*

*Attesting Officer*

HARRY F. MANBECK, JR.

*Commissioner of Patents and Trademarks*